US010020108B2

(12) United States Patent
Nakamura et al.

(10) Patent No.: US 10,020,108 B2
(45) Date of Patent: Jul. 10, 2018

(54) METHOD FOR PRODUCING MAGNETIC PARTICLES, MAGNETIC PARTICLES, AND MAGNETIC BODY

(71) Applicants: NISSHIN SEIFUN GROUP INC., Tokyo (JP); NISSHIN ENGINEERING INC., Tokyo (JP)

(72) Inventors: Keitaroh Nakamura, Fujimino (JP); Akihiro Kinoshita, Fujimino (JP); Naohito Uemura, Fujimino (JP)

(73) Assignees: NISSHIN SEIFUN GROUP INC., Tokyo (JP); NISSHIN ENGINEERING INC., Tokyo (JP)

( * ) Notice: Subject to any disclaimer, the term of this patent is extended or adjusted under 35 U.S.C. 154(b) by 123 days.

(21) Appl. No.: 14/764,442

(22) PCT Filed: Jan. 22, 2014

(86) PCT No.: PCT/JP2014/051239
§ 371 (c)(1),
(2) Date: Jul. 29, 2015

(87) PCT Pub. No.: WO2014/122993
PCT Pub. Date: Aug. 14, 2014

(65) Prior Publication Data

US 2015/0380149 A1 Dec. 31, 2015

(30) Foreign Application Priority Data

Feb. 6, 2013 (JP) ..... 2013-021820

(51) Int. Cl.
*H01F 5/00* (2006.01)
*H01F 27/255* (2006.01)
(Continued)

(52) U.S. Cl.
CPC ..... *H01F 27/255* (2013.01); *B22F 1/02* (2013.01); *C22C 38/00* (2013.01); *H01F 1/061* (2013.01);
(Continued)

(58) Field of Classification Search
CPC .. H01F 5/00; H01F 17/06; H01F 27/00–27/36
(Continued)

(56) References Cited

U.S. PATENT DOCUMENTS

2006/0068232 A1* 3/2006 Mikamo ..... G11B 5/70626 428/842.9
2009/0226764 A1* 9/2009 Srinivasan ..... C23C 14/165 428/846
(Continued)

FOREIGN PATENT DOCUMENTS

JP 2007-258427 A 10/2007
JP 2008-108943 A 5/2008
(Continued)

*Primary Examiner* — Tuyen Nguyen
(74) *Attorney, Agent, or Firm* — Muncy, Geissler, Olds & Lowe, P.C.

(57) ABSTRACT

This method for producing magnetic particles comprises a nitriding treatment step for applying a nitriding treatment to material particles each having a core-shell structure in which an aluminum oxide layer is formed on the surface of an iron microparticle, and nitriding the iron microparticles while maintaining the core-shell structure.

10 Claims, 8 Drawing Sheets

(51) Int. Cl.

| | |
|---|---|
| ***B22F 1/02*** | (2006.01) |
| ***C22C 38/00*** | (2006.01) |
| ***H01F 1/06*** | (2006.01) |
| ***H01F 41/02*** | (2006.01) |

(52) U.S. Cl.
CPC ..... *H01F 5/00* (2013.01); *H01F 41/0206* (2013.01); *H01F 41/0246* (2013.01); *C22C 2202/02* (2013.01)

(58) Field of Classification Search
USPC ..... 29/602.1; 336/65, 83, 200, 232–234
See application file for complete search history.

(56) References Cited

U.S. PATENT DOCUMENTS

| | | | | |
|---|---|---|---|---|
| 2010/0035086 | A1* | 2/2010 | Inoue ..... | G11B 5/70626 428/811.2 |
| 2010/0227201 | A1* | 9/2010 | Sasaki ..... | G11B 5/70 428/839 |
| 2011/0151281 | A1* | 6/2011 | Inoue ..... | G11B 5/70 428/846 |
| 2012/0244356 | A1 | 9/2012 | Takahashi et al. | |
| 2013/0257573 | A1 | 10/2013 | Takahashi et al. | |
| 2014/0001398 | A1 | 1/2014 | Takahashi et al. | |
| 2015/0380158 | A1* | 12/2015 | Brady ..... | C23C 28/322 148/105 |

FOREIGN PATENT DOCUMENTS

| | | | |
|---|---|---|---|
| JP | 2008181916 | A | 8/2008 |
| JP | 2011-91215 | A | 5/2011 |
| JP | 2012-69811 | A | 4/2012 |
| JP | 2012-149326 | A | 8/2012 |

* cited by examiner

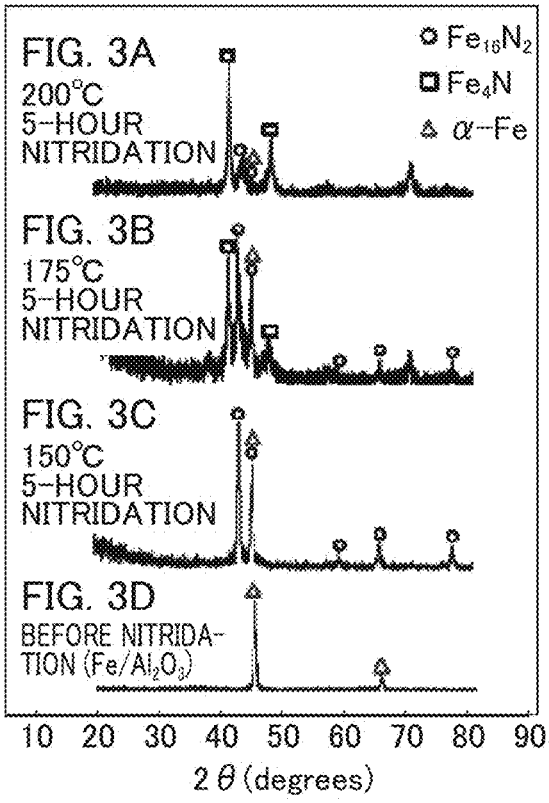
FIG. 3A
200°C
5-HOUR
NITRIDATION
FIG. 3B
175°C
5-HOUR
NITRIDATION
FIG. 3C
150°C
5-HOUR
NITRIDATION
FIG. 3D
BEFORE NITRIDATION (Fe/Al2O3)
Fe16N2
Fe4N
α-Fe
10 20 30 40 50 60 70 80 90
2θ (degrees)
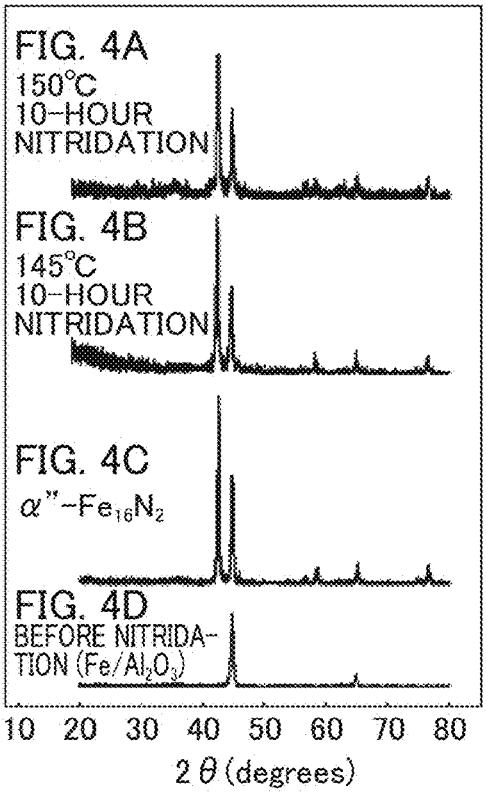
FIG. 4A
150°C
10-HOUR
NITRIDATION
FIG. 4B
145°C
10-HOUR
NITRIDATION
FIG. 4C
α"-Fe16N2
FIG. 4D
BEFORE NITRIDATION (Fe/Al2O3)
10 20 30 40 50 60 70 80
2θ (degrees)

BEFORE NITRIDATION

AFTER NITRIDATION

AFTER NITRIDATION

COATING LAYER MAINTAINED

145°C
6-HOUR
NITRIDATION

145°C
12-HOUR
NITRIDATION

145°C
18-HOUR
NITRIDATION

α"-Fe16N2
10 20 30 40 50 60 70 80
2θ (degrees)

BEFORE NITRIDATION

AFTER NITRIDATION

AFTER NITRIDATION

FIG. 10A
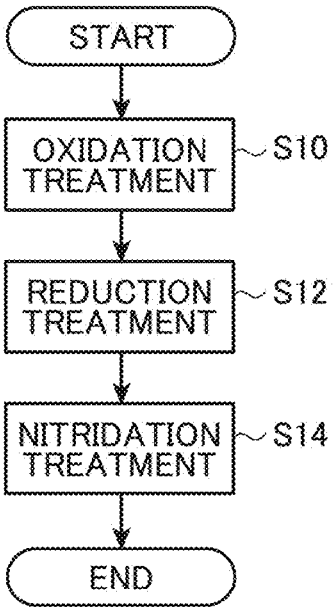
FIG. 10B
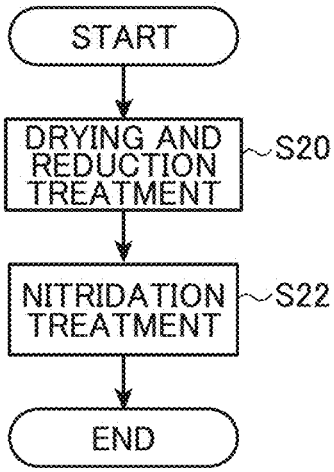
FIG. 10C
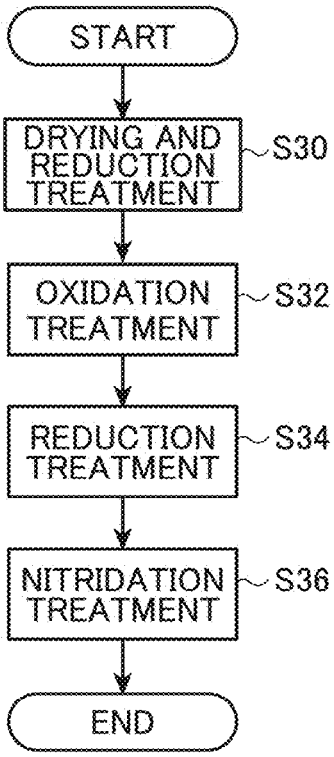
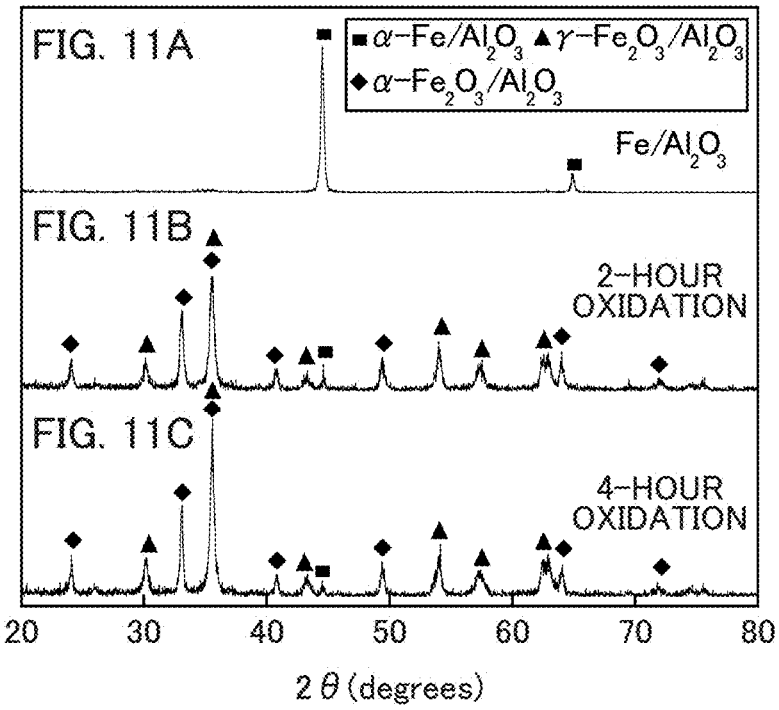

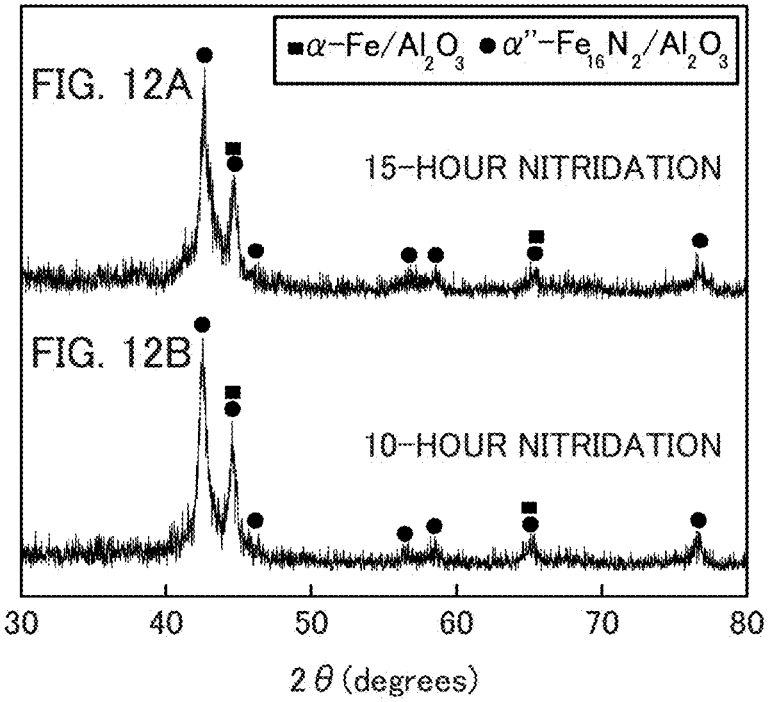
FIG. 13
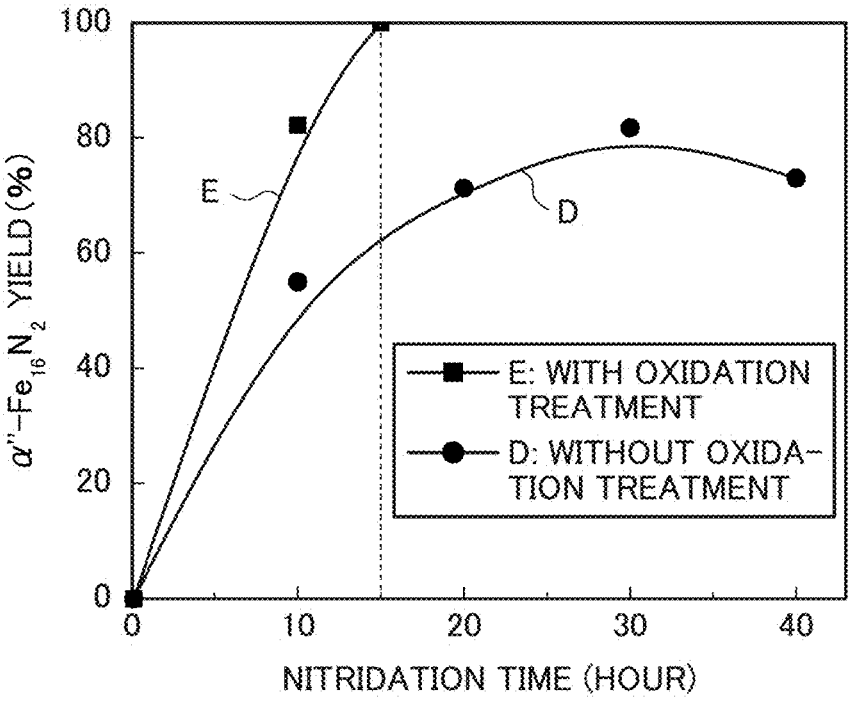

METHOD FOR PRODUCING MAGNETIC PARTICLES, MAGNETIC PARTICLES, AND MAGNETIC BODY

TECHNICAL FIELD

The present invention relates to magnetic particles each having a core-shell structure in which an aluminum oxide layer is formed on the surface of an iron nitride fine particle, a method for producing such magnetic particles and a magnetic body using the magnetic particles, particularly to magnetic particles produced by at least nitridation treatment so that the magnetic particles each have a core-shell structure in which an aluminum oxide layer is formed on the surface of an iron nitride fine particle and take on a spherical shape, as well as a method for producing the magnetic particles and a magnetic body using the magnetic particles.

BACKGROUND ART

Today, motors for hybrid vehicles, electric vehicles, home electric appliances such as air conditioners and washing machines, industrial machineries and the like are required to be energy-saving and to have high efficiency and high performance characteristics. Accordingly, a magnet used for such a motor is required to have a higher magnetic force (coercive force, saturation magnetic flux density). At present, iron nitride-based magnetic particles are attracting attention as magnetic particles constituting a magnet and various proposals have been made on the iron nitride-based magnetic particles (see Patent Literatures 1 to 3).

Patent Literature 1 describes ferromagnetic particles which comprise an $Fe_{16}N_2$ single phase, have surfaces coated with a Si compound and/or an Al compound and have a $BH_{max}$ value of not less than 5 MGOe. The ferromagnetic particles can be obtained by coating the surfaces of iron compound particles with the Si compound and/or the Al compound, followed by reducing treatment and then nitridation treatment. The iron compound particles used as a starting material are composed of iron oxide or iron oxyhydroxide.

Patent Literature 2 describes ferromagnetic particles which comprise an $Fe_{16}N_2$ compound phase in an amount of not less than 70% as measured by Mössbauer spectrum, contain a metal element X in such an amount that a molar ratio of the metal element X to Fe is 0.04 to 25%, have surfaces coated with an Si compound and/or an Al compound and have a $BH_{max}$ value of not less than 5 MGOe. The metal element X is at least one element selected from the group consisting of Mn, Ni, Ti, Ga, Al, Ge, Zn, Pt and Si.

The ferromagnetic particles are obtained by subjecting iron compound particles previously passed through a mesh having a size of not more than 250 μm to reducing treatment and then to nitridation treatment, the iron compound particles used as a starting material being formed of iron oxide or iron oxyhydroxide which has a BET specific surface area of 50 to 250 $m^2/g$, an average major axis diameter of 50 to 450 nm and an aspect ratio (major axis diameter/minor axis diameter) of 3 to 25 and comprises a metal element X (wherein X is at least one element selected from the group consisting of Mn, Ni, Ti, Ga, Al, Ge, Zn, Pt and Si) in such an amount that a molar ratio of the metal element X to Fe is 0.04 to 25%.

Patent Literature 3 describes ferromagnetic particles comprising an $Fe_{16}N_2$ compound phase in an amount of not less than 80% as measured by Mössbauer spectrum, and each having an outer shell in which FeO is present in the form of a film having a thickness of not more than 5 nm.

The ferromagnetic particles are obtained by subjecting iron oxide or iron oxyhydroxide having an average major axis diameter of 40 to 5000 nm and an aspect ratio (major axis diameter/minor axis diameter) of 1 to 200 as a starting material to dispersing treatment to prepare aggregated particles having D50 of not more than 40 μm and D90 of not more than 150 μm, allowing the obtained aggregated particles to pass through a mesh having a size of not more than 250 μm, subjecting the iron compound particles passed through the mesh to hydrogen reducing treatment at a temperature of 160 to 420° C. and then subjecting the resulting particles to nitridation treatment at a temperature of 130 to 170° C.

CITATION LIST

Patent Literature

Patent Literature 1: JP 2011-91215 A
Patent Literature 2: JP 2012-69811 A
Patent Literature 3: JP 2012-149326 A

SUMMARY OF INVENTION

Technical Problems

In Patent Literatures 1 to 3, while the magnetic particles with a minor axis diameter and a major axis diameter differing in length are obtained, spherical magnetic particles cannot be obtained. The magnetic particles with a minor axis diameter and a major axis diameter differing in length have anisotropy in terms of magnetic properties. Furthermore, the magnetic particles obtained in Patent Literatures 1 to 3 tend to be fused during reduction treatment at high temperature and are poor in dispersibility.

An object of the present invention is to solve the above problems inherent in the prior art and to provide a method for producing, by at least nitridation treatment, magnetic particles each having a core-shell structure in which an aluminum oxide layer is formed on the surface of an iron nitride fine particle and having a spherical shape, as well as magnetic particles thus produced and a magnetic body using the magnetic particles.

Solution to Problems

In order to attain the above object, the present invention provides as its first aspect a magnetic particle producing method, comprising: a nitridation treatment step of subjecting material particles each having a core-shell structure in which an aluminum oxide layer is formed on a surface of an iron fine particle to nitridation treatment to nitride iron fine particles with the core-shell structure being maintained.

Preferably, the nitridation treatment is performed by, as supplying nitrogen element-containing gas to the material particles, heating the material particles to a temperature of 140° C. to 200° C. and retaining the temperature for 3 to 50 hours. More preferably, the nitridation treatment is performed by heating the material particles to a temperature of 140° C. to 160° C. and retaining the temperature for 3 to 20 hours.

The material particles have a particle size of preferably less than 200 nm and more preferably 5 to 50 nm.

Preferably, the magnetic particle producing method includes a drying and reduction treatment step of subjecting the material particles to drying and reduction treatment before the nitridation treatment step and in the nitridation treatment step, the nitridation treatment is performed on the material particles having undergone the drying and reduction treatment.

Preferably, the drying and reduction treatment is performed by, as supplying hydrogen gas or hydrogen gas-containing inert gas, heating the material particles to a temperature of 200° C. to 500° C. in a hydrogen gas atmosphere or a hydrogen gas-containing inert gas atmosphere and retaining the temperature for 1 to 20 hours.

Also in this case, preferably, the nitridation treatment is performed by, as supplying nitrogen element-containing gas to the material particles, heating the material particles to a temperature of 140° C. to 200° C. and retaining the temperature for 3 to 50 hours. More preferably, the nitridation treatment is performed by heating the material particles to a temperature of 140° C. to 160° C. and retaining the temperature for 3 to 20 hours.

Preferably, the magnetic particle producing method includes an oxidation treatment step of subjecting the material particles to oxidation treatment and a reduction treatment step of subjecting the material particles having undergone the oxidation treatment to reduction treatment and in the nitridation treatment step, the nitridation treatment is performed on the material particles having undergone the reduction treatment.

Preferably, the oxidation treatment is performed by heating the material particles to a temperature of 100° C. to 500° C. in air and retaining the temperature for 1 to 20 hours.

Preferably, the reduction treatment is performed by, as supplying mixed gas of hydrogen gas and nitrogen gas to the material particles, heating the material particles to a temperature of 200° C. to 500° C. and retaining the temperature for 1 to 20 hours.

Preferably, the nitridation treatment is performed by, as supplying nitrogen element-containing gas to the material particles, heating the material particles to a temperature of 140° C. to 200° C. and retaining the temperature for 3 to 50 hours. Also in this case, more preferably, the nitridation treatment is performed by heating the material particles to a temperature of 140° C. to 160° C. and retaining the temperature for 3 to 20 hours.

The drying and reduction treatment step may come before the nitridation treatment step, and the oxidation treatment step and the reduction treatment step may come in this order after the drying and reduction treatment step.

The present invention provides as its second aspect magnetic particles being spherical particles each having a core-shell structure in which an aluminum oxide layer is formed on a surface of an iron nitride fine particle.

The present invention provides as its third aspect a magnetic body formed using spherical particles each having a core-shell structure in which an aluminum oxide layer is formed on a surface of an iron nitride fine particle.

Advantageous Effects of Invention

According to the present invention, it is possible to obtain, by at least nitridation treatment, magnetic particles each having a core-shell structure in which an aluminum oxide layer is formed on the surface of an iron nitride fine particle and having a spherical shape. The obtained magnetic particles each have the surface constituted by the aluminum oxide layer and therefore, the iron nitride fine particles do not come into direct contact with each other. Furthermore, owing to the aluminum oxide layer that is an insulator, each iron nitride fine particle is electrically insulated from another particle and this can suppress electric current flowing between adjacent magnetic particles. As a result, a loss caused by electric current can be suppressed.

Furthermore, since the nitridation treatment step is preceded by the drying and reduction treatment step in which the material particles are subjected to the drying and reduction treatment or the oxidation treatment step in which the material particles are subjected to the oxidation treatment and the reduction treatment step in which the oxidized material particles are subjected to the reduction treatment, the nitridation treatment time can be shortened.

Since the fine particles are composed of iron nitride, the magnetic particles of the invention and the magnetic body produced using the magnetic particles have a high coercive force and excellent magnetic properties.

BRIEF DESCRIPTION OF DRAWINGS

FIGS. 3A to 3C are graphs showing analysis results of crystal structures as obtained after nitridation treatment by X-ray diffractometry and FIG. 3D is a graph showing an analysis result of a crystal structure as obtained before nitridation treatment by X-ray diffractometry.

FIGS. 4A and 4B are graphs showing analysis results of crystal structures as obtained after nitridation treatment by X-ray diffractometry, FIG. 4C is a graph showing an analysis result of a crystal structure of $Fe_{16}N_2$ as obtained by X-ray diffractometry and FIG. 4D is a graph showing an analysis result of a crystal structure as obtained before nitridation treatment by X-ray diffractometry.

FIG. 10A is a flowchart of a first example among alternative methods for producing the magnetic particles of the invention, FIG. 10B is a flowchart of a second example among alternative methods for producing the magnetic particles of the invention and FIG. 10C is a flowchart of a third example among alternative methods for producing the magnetic particles of the invention.

FIG. 11A is a graph showing an analysis result of a crystal structure as obtained before oxidation treatment by X-ray diffractometry and FIGS. 11B and 11C are graphs showing analysis results of crystal structures as obtained after oxidation treatment by X-ray diffractometry.

FIGS. 12A and 12B are graphs showing analysis results of crystal structures as obtained after oxidation treatment, reduction treatment and nitridation treatment by X-ray diffractometry.

FIG. 13 is a graph showing the relation between the nitridation treatment time and the iron nitride yield as to magnetic particles produced by a method in which the nitridation treatment is preceded by the oxidation treatment and the reduction treatment and the relation therebetween as to magnetic particles produced only by nitridation treatment.

DESCRIPTION OF EMBODIMENTS

A method for producing magnetic particles, magnetic particles and magnetic body according to the invention are described below in detail with reference to preferred embodiments shown in the accompanying drawings.

Figure 1A:
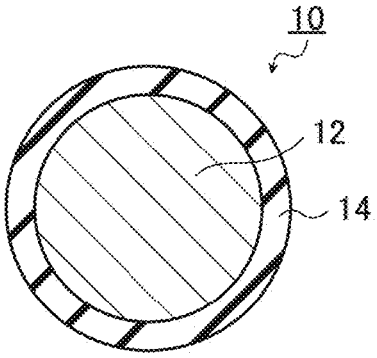
FIG. 1A is a schematic cross-sectional view showing a magnetic particle of the invention and FIG. 1B is a schematic cross-sectional view showing a material particle.
Figure 1B:
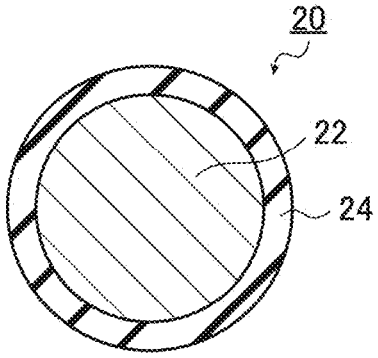
Figure 2:
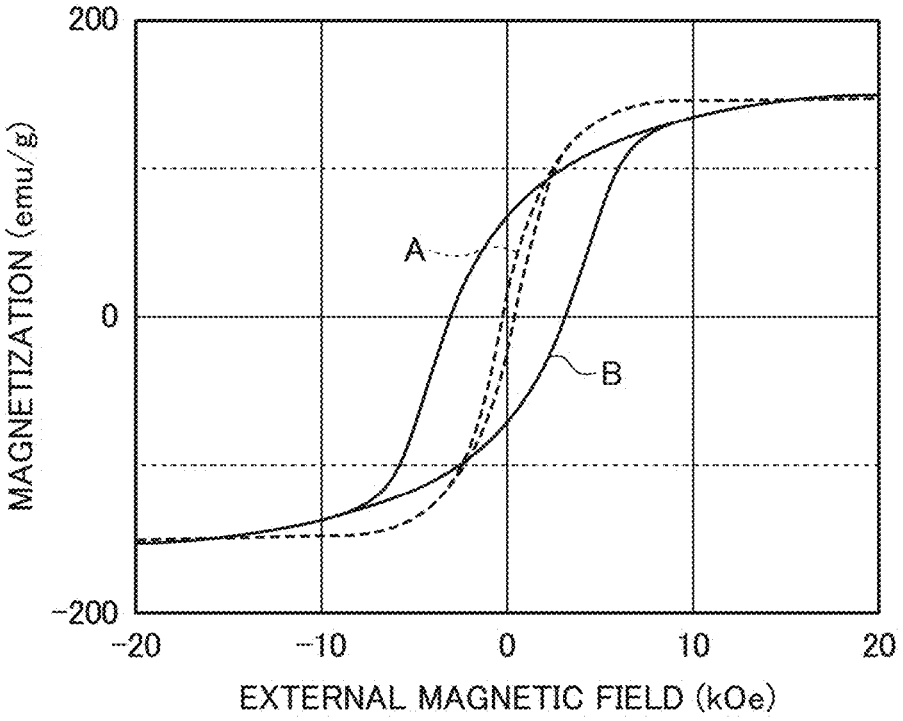
FIG. 2 is a graph showing an example of magnetic hysteresis curves (B-H curves) of the magnetic particles and the material particles.

FIG. 1A is a schematic cross-sectional view showing a magnetic particle of the invention and FIG. 1B is a schematic cross-sectional view showing a material particle. FIG. 2 is a graph showing an example of magnetic hysteresis curves (B-H curves) of the magnetic particles and the material particles.

As shown in FIG. 1A, a magnetic particle 10 of this embodiment is a spherical particle having a core-shell structure in which an aluminum oxide layer ($Al_2O_3$ layer) 14 (shell) is formed on the surface of an iron nitride fine particle 12 (core).

The magnetic particle 10 is a spherical particle having a particle size of about 50 nm and preferably of 5 to 50 nm. The particle size is obtained by converting a measurement value of the specific surface area.

In the magnetic particle 10, the iron nitride fine particle 12 exerts magnetic properties. Among iron nitrides, $Fe_{16}N_2$ having excellent magnetic properties is most preferable in terms of magnetic properties such as coercive force. Therefore, the fine particle 12 is most preferably constituted by $Fe_{16}N_2$ single phase. When the fine particle 12 is constituted by the $Fe_{16}N_2$ single phase, the magnetic particle 10 is also referred to as "$Fe_{16}N_2/Al_2O_3$ composite fine particle."

The fine particle 12 is not limited in component to the $Fe_{16}N_2$ single phase and may have the composition having another iron nitride included therein.

The aluminum oxide layer 14 serves to electrically insulate the fine particle 12, prevent the fine particle 12 from coming into contact with another magnetic particle or the like and suppress oxidation or the like of the fine particle. This aluminum oxide layer 14 is an insulator.

Since including the iron nitride fine particle 12, the magnetic particle 10 has a high coercive force and excellent magnetic properties. As will be described in detail later, when the fine particle 12 is composed of the $Fe_{16}N_2$ single phase, the coercive force is to be, for instance, 3070 Oe (about 244.3 kA/m). The magnetic particle 10 is excellent also in dispersibility.

In the magnetic particle 10, the aluminum oxide layer 14 serves to suppress electric current flowing between the magnetic particle 10 and another magnetic particle and consequently, a loss caused by electric current can be suppressed.

A magnetic body produced using such magnetic particles as the magnetic particle 10 has a high coercive force and excellent magnetic properties. One example of the magnetic body is a bonded magnet.

Next, a method for producing the magnetic particle 10 is described.

The magnetic particle 10 can be produced with the use of a material particle 20 shown in FIG. 1B as the material by subjecting the material particle 20 to nitridation treatment (nitridation treatment step). The material particle 20 has a core-shell structure in which an aluminum oxide layer 24 is formed on the surface of an iron (Fe) fine particle 22. The material particle 20 is also referred to as "$Fe/Al_2O_3$ particle."

The material particle 20 is a spherical particle having a particle size of about 50 nm and preferably 5 to 50 nm. The particle size is obtained by converting a measurement value of the specific surface area.

The iron fine particle 22 is nitrided by nitridation treatment to obtain a fine particle composed of iron nitride and most preferably of $Fe_{16}N_2$. At this time, the aluminum oxide layer 24 is composed of a stable substance which does not change into another substance through the nitridation treatment. Thus, the iron fine particle 22 that is a core is nitrided and changed into the iron nitride fine particle 12 with the core-shell structure being maintained, thereby obtaining the magnetic particle 10 shown in FIG. 1A.

As described later, the produced magnetic particle 10 is free from aggregation and have high dispersibility. Since the magnetic particle 10 can be produced solely by the nitridation treatment of the material particle 20, transfer of the material particle to another step and other possible processes can be omitted and accordingly, the production efficiency can be improved.

Methods of the nitridation treatment include a method in which: the material particle 20 is put into, for example, a glass container; nitrogen element-containing gas such as $NH_3$ gas (ammonia gas) is supplied as a nitrogen source into this container; with the $NH_3$ gas (ammonia gas) having been supplied, the material particle 20 is heated to a temperature of, for example, 140° C. to 200° C.; and this temperature is retained for 3 to 50 hours. In this method, the nitridation treatment is performed more preferably at a temperature of 140° C. to 160° C. with a retention time of 3 to 20 hours.

In the present invention, the nitridation treatment method is not limited to the foregoing method as long as the iron fine particle 22 that is a core can be nitrided and changed into the iron nitride fine particle 12 with the core-shell structure of the material particle 20 as the material being maintained.

The material particle 20 ($Fe/Al_2O_3$ particles) shown in FIG. 1B can be produced by a method of producing superfine particles using thermal plasma disclosed by, for example, JP 4004675 B (a method of producing oxide-coated metallic fine particles). Therefore, a detailed explanation thereof will not be made. It should be noted that the method of producing the material particle 20 is not limited to the one using thermal plasma as long as the material particle 20 ($Fe/Al_2O_3$ particles) can be produced.

The material particle 20 used as the material and the magnetic particle 10 were measured for magnetic properties. The results are shown in FIG. 2.

As shown in FIG. 2, magnetic hysteresis curves (B-H curves) denoted by the letter A were obtained with the material particles 20 and magnetic hysteresis curves (B-H curves) denoted by the letter B were obtained with the magnetic particles 10. As can be seen from the magnetic hysteresis curves A and B, the magnetic particles 10 are more excellent in magnetic properties. Having the iron nitride fine particles 12 as cores, the magnetic particles 10 can have a coercive force of, for instance, 3070 Oe (about 244.3 kA/m) which is higher than that of the material particles 20 having cores composed of iron. In addition, the magnetic particles 10 can have a saturation magnetic flux density of 162 emu/g (about $2.0\times10^{-4}$ Wb·m/kg).

The nitridation treatment is preferably performed at a nitridation treatment temperature of 140° C. to 200° C. At a nitridation treatment temperature of less than 140° C., the degree of nitridation is not sufficient. At a nitridation treatment temperature in excess of 200° C., the material particles are fused while nitridation is saturated.

The nitridation treatment time is preferably 3 to 50 hours. At a nitridation treatment time of less than 3 hours, the degree of nitridation is not sufficient. At a nitridation treatment time in excess of 50 hours, the material particles are fused while nitridation is saturated.

The present applicants analyzed crystal structures before and after nitridation treatment by X-ray diffractometry using material particles ($Fe/Al_2O_3$ particles) having a particle size of 10 nm as the material, thereby examining the influence of the temperature in nitridation treatment. The results are shown in FIGS. 3A to 3C. The particle size was obtained by converting a measurement value of the specific surface area.

FIG. 3A shows an analysis result of a crystal structure with a nitridation treatment temperature of 200° C., FIG. 3B shows that with a nitridation treatment temperature of 175° C. and FIG. 3C shows that with a nitridation treatment temperature of 150° C. The retention time in nitridation treatment was 5 hours in each case.

FIG. 3D shows an analysis result of a crystal structure of the material particles ($Fe/Al_2O_3$ particles).

Compared to FIG. 3D, FIGS. 3A to 3C associated with the crystal structures after nitridation show that iron nitride was produced. In particular, a nitridation treatment temperature of 150° C. led to a substantially single phase of iron nitride ($Fe_{16}N_2$).

The influence of the nitridation treatment temperature was examined with a nitridation treatment time of 10 hours. The results are shown in FIGS. 4A and 4B.

FIG. 4A shows an analysis result of a crystal structure with a nitridation treatment temperature of 150° C. and FIG. 4B shows that with a nitridation treatment temperature of 145° C. FIG. 4C shows an analysis result of a crystal structure of $Fe_{16}N_2$ as obtained by X-ray diffractometry. FIG. 4D shows an analysis result of a crystal structure of the material particles ($Fe/Al_2O_3$ particles).

Compared to FIG. 4D with reference to FIG. 4C, FIGS. 4A and 4B each show the diffraction peaks of $Fe_{16}N_2$ and therefore, it is clear that iron was changed into iron nitride by nitridation treatment.

Figures 5A, 5B, 5C:
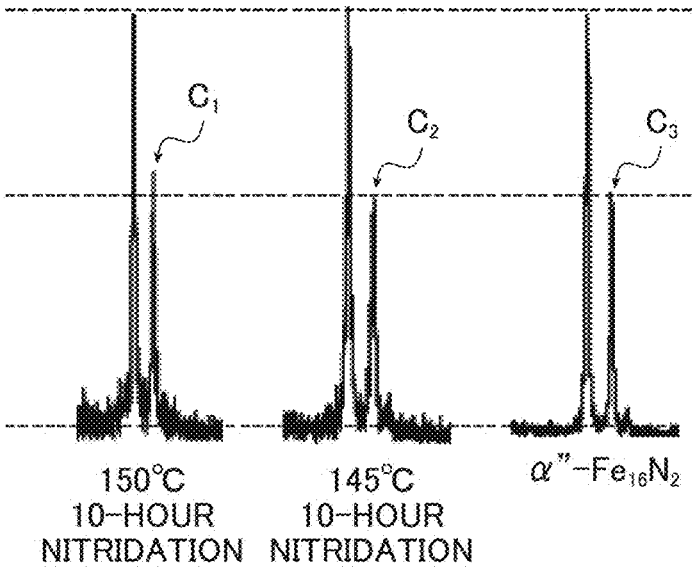
FIGS. 5A and 5B are graphs showing the analysis results of the crystal structures as obtained after nitridation treatment by X-ray diffractometry and FIG. 5C is a graph showing the analysis result of the crystal structure of $Fe_{16}N_2$ as obtained by X-ray diffractometry.

FIGS. 5A to 5C are enlarged diagrams of FIGS. 4A to 4C. FIG. 5A shows the analysis result of the crystal structure with a nitridation treatment temperature of 150° C. and FIG. 5B shows that with a nitridation treatment temperature of 145° C. FIG. 5C shows the analysis result of the crystal structure of $Fe_{16}N_2$ as obtained by X-ray diffractometry.

Comparing FIGS. 5A and 5B with reference to FIG. 5C for the respective diffraction peaks on the right side, the diffraction peak $C_2$ in FIG. 5B is more equivalent in height to the right-side diffraction peak $C_3$ of $Fe_{16}N_2$ in FIG. 5C than the diffraction peak $C_1$ in FIG. 5A and thus, iron was completely changed to iron nitride by nitridation treatment at a nitridation treatment temperature of 145° C.

Figures 6A, 6B, 6C:
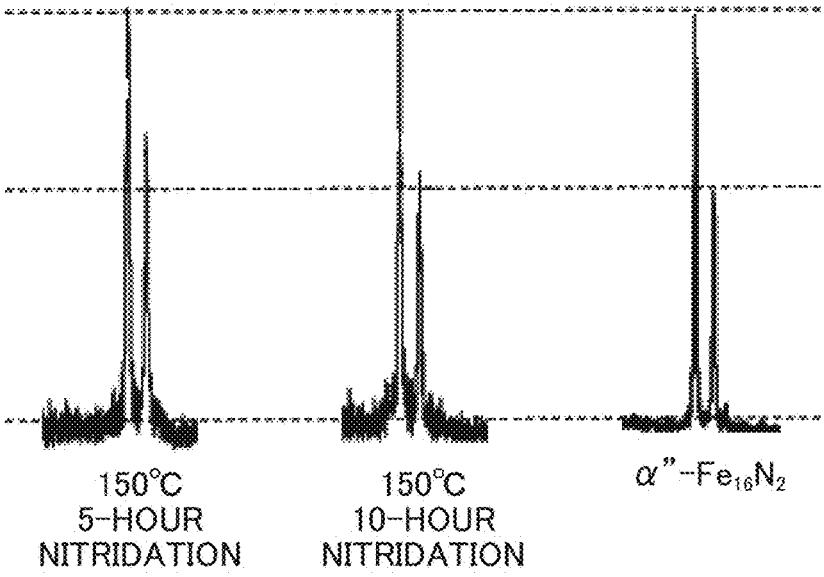
FIGS. 6A and 6B are graphs showing the analysis results of the crystal structures as obtained after nitridation treatment by X-ray diffractometry and FIG. 6C is a graph showing the analysis result of the crystal structure of $Fe_{16}N_2$ as obtained by X-ray diffractometry.

The analysis results in FIGS. 3C and 4A associated with nitridation treatment at a nitridation treatment temperature of 150° C. are shown in FIGS. 6A and 6B for comparison together with the analysis result of the crystal structure of $Fe_{16}N_2$ (FIG. 6C). FIG. 6A shows the case with a nitridation treatment time of 5 hours and FIG. 6B shows the case with a nitridation treatment time of 10 hours.

Comparing FIGS. 6A and 6B, the diffraction peak pattern with a nitridation treatment time of 10 hours (see FIG. 6B) is closer to the diffraction peak pattern of $Fe_{16}N_2$. Thus, compared to the case with a nitridation treatment time of 5 hours (see FIG. 6A), nitridation progressed more with a longer nitridation treatment time, thereby achieving the change into $Fe_{16}N_2$.

For the magnetic particles associated with the result shown in FIG. 4A (FIG. 6B), their particle conditions before and after nitridation treatment were observed. The results are shown in FIGS. 7A to 7C.

Figure 7A:
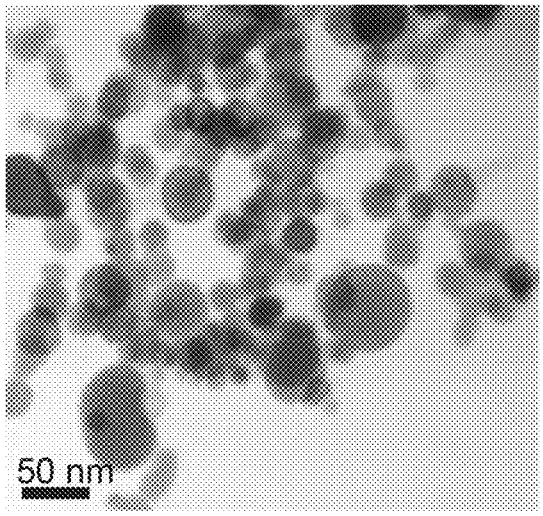
FIG. 7A is a schematic view showing a TEM image of material particles before nitridation treatment having a particle size of 10 nm.
Figure 7B:
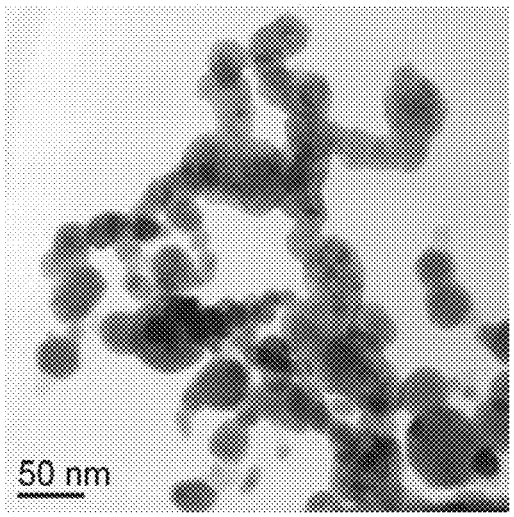
FIG. 7B is a schematic view showing a TEM image of the magnetic particles and FIG. 7C is a schematic view showing an enlarged TEM image of the magnetic particles.
Figure 7C:
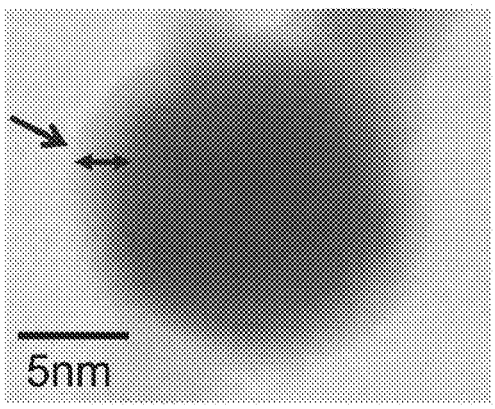

FIG. 7A shows a TEM image of the material particles, FIG. 7B shows a TEM image of the magnetic particles and FIG. 7C shows an enlarged TEM image of the magnetic particles of FIG. 7B.

As can be seen in FIGS. 7A and 7B, no considerable change was found between the particle structures before and after nitridation treatment and as shown in FIG. 7C, the magnetic particles were obtained with the core-shell structure being maintained even after nitridation treatment. In addition, as shown in FIG. 7B, the magnetic particles did not aggregate but disperse.

Figures 8A, 8B, 8C, 8D:
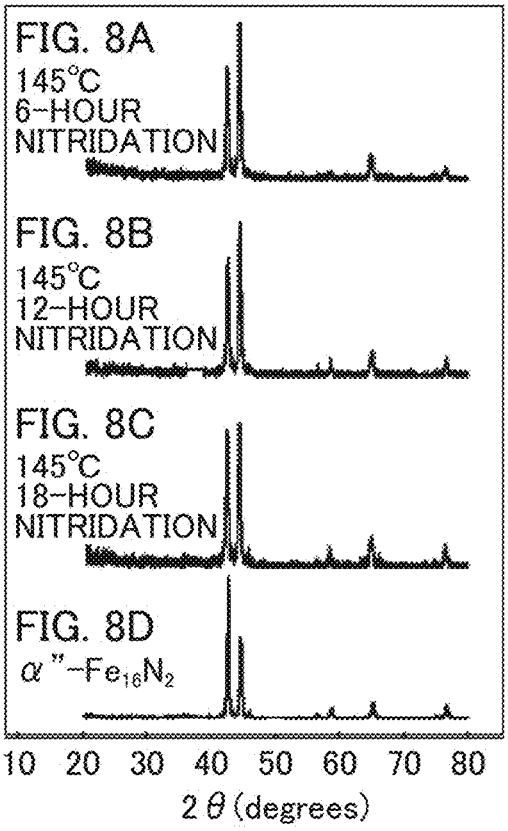
FIGS. 8A to 8C are graphs showing analysis results of crystal structures as obtained after nitridation treatment by X-ray diffractometry and FIG. 8D is a graph showing an analysis result of a crystal structure of $Fe_{16}N_2$ as obtained by X-ray diffractometry.

The present applicants analyzed crystal structures with different nitridation treatment times by X-ray diffractometry using material particles ($Fe/Al_2O_3$ particles) having a particle size of 50 nm as the material. The results are shown in FIGS. 8A to 8C. The particle size was obtained by converting a measurement value of the specific surface area.

FIG. 8A shows an analysis result with a nitridation treatment temperature of 145° C. and a nitridation treatment time of 6 hours, FIG. 8B shows that with a nitridation treatment temperature of 145° C. and a nitridation treatment time of 12 hours and FIG. 8C shows that with a nitridation treatment temperature of 145° C. and a nitridation treatment time of 18 hours.

Comparing FIGS. 8A to 8C with reference to FIG. 8D, nitridation further progressed with increasing nitridation treatment time. However, nitridation did not sufficiently progress compared to the above-described case with a particle size of 10 nm. A nitridation treatment temperature of 145° C. is the temperature with which the most favorable nitridation result was obtained with a particle size of 10 nm.

Figure 9A:
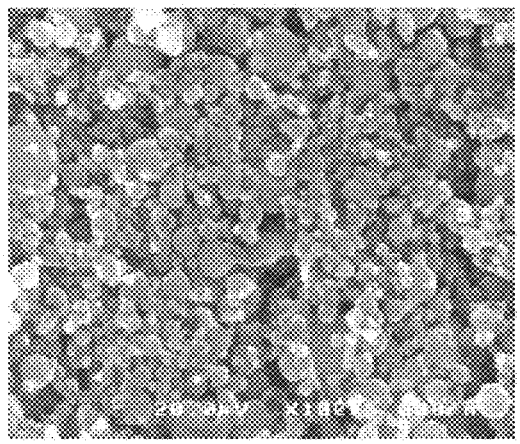
FIG. 9A is a schematic view showing an SEM image of material particles before nitridation treatment having a particle size of 50 nm.
Figure 9B:
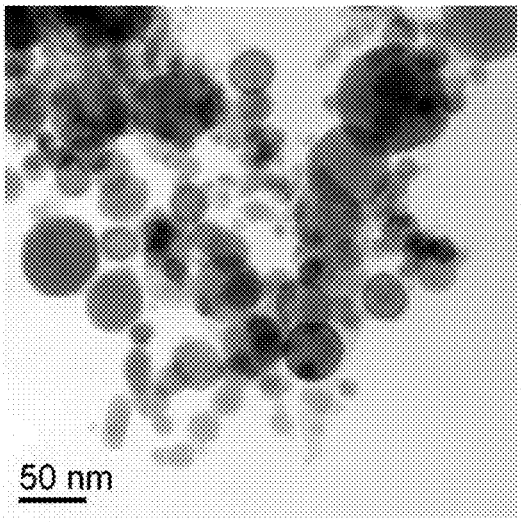
FIG. 9B is a schematic view showing a TEM image of the magnetic particles and FIG. 9C is a schematic view showing an enlarged TEM image of the magnetic particles.
Figure 9C:
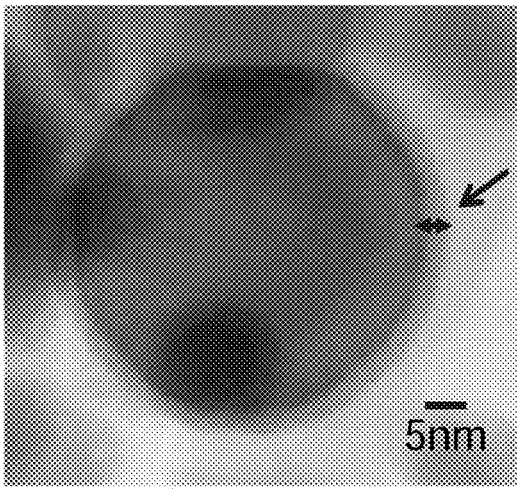

As to the case of using the material particles ($Fe/Al_2O_3$ particles) having a particle size of 50 nm as described above, the particles were observed for the particle conditions before and after nitridation treatment. The results are shown in FIGS. 9A to 9C. FIG. 9A shows a SEM image of the material particles, FIG. 9B shows a TEM image of the magnetic particles and FIG. 9C shows an enlarged TEM image of the magnetic particles of FIG. 9B.

As can be seen in FIGS. 9A and 9B, even in the case of a particle size of 50 nm, no considerable change was found between the particle structures before and after nitridation treatment and as shown in FIG. 9C, the magnetic particles were obtained with the core-shell structure being maintained even after nitridation treatment.

Next, alternative methods for producing the magnetic particles of the invention are described.

FIG. 10A is a flowchart of a first example among alternative methods for producing the magnetic particles of the invention, FIG. 10B is a flowchart of a second example among alternative methods for producing the magnetic particles of the invention and FIG. 10C is a flowchart of a third example among alternative methods for producing the magnetic particles of the invention.

The present invention is not limited to the magnetic particle producing method in which the material particles are subjected to nitridation treatment to obtain the magnetic particles. As shown in FIG. 10A, the material particles 20 are subjected to oxidation treatment before nitridation treatment to oxidize the iron (Fe) fine particles 22 (Step S10). Subsequently, the material particles 20 are subjected to reduction treatment to reduce the oxidized iron (Fe) fine particles 22 (Step S12). Thereafter, the material particles 20 are subjected to nitridation treatment to nitride the reduced iron (Fe) fine particles 22 (Step S14). The magnetic particles 10 having the iron nitride fine particles 12 can be thus produced.

As described above, the iron fine particles 22 are oxidized in the oxidation treatment step (Step S10), subsequently the oxidized iron fine particles 22 are reduced in the reduction treatment step (Step S12) and then the iron fine particles 22 are nitrided in the nitridation treatment step (Step S14), thereby obtaining fine particles composed of iron nitride and most preferably of $Fe_{16}N_2$. At this time, the aluminum oxide layers 24 are composed of a stable substance which does not change into another substance through the oxidation treatment, the reduction treatment and the nitridation treatment. Thus, each iron fine particle 22 that is a core is oxidized, reduced and nitrided to be changed into the iron nitride fine particle 12 with the core-shell structure being maintained, thereby obtaining the magnetic particle 10 shown in FIG. 1A.

Methods of the oxidation treatment include a method in which: the material particles 20 are put into, for example, a glass container; air is supplied into this container; the material particles 20 are heated to a temperature of, for example, 100° C. to 500° C. in the air; and this temperature is retained for 1 to 20 hours. In this method, the oxidation treatment is performed more preferably at a temperature of 200° C. to 400° C. with a retention time of 1 to 10 hours.

At an oxidation treatment temperature of less than 100° C., the degree of oxidation is not sufficient. At an oxidation treatment temperature in excess of 500° C., the material particles are fused. In addition, the oxidation reaction is saturated so that oxidation does not progress any more.

With an oxidation treatment time of less than 1 hour, the degree of oxidation is not sufficient. With an oxidation treatment time in excess of 20 hours, the material particles are fused. In addition, the oxidation reaction is saturated so that oxidation does not progress any more.

Methods of the reduction treatment include a method in which: the material particles 20 having undergone the oxidation treatment are put into, for example, a glass container; hydrogen gas ($H_2$ gas) or hydrogen gas-containing inert gas is supplied into this container; the material particles 20 are heated to a temperature of, for example, 200° C. to 500° C. in a hydrogen gas atmosphere or a hydrogen gas-containing inert gas atmosphere; and this temperature is retained for 1 to 50 hours. In this method, the reduction treatment is performed more preferably at a temperature of 200° C. to 400° C. with a retention time of 1 to 30 hours.

At a reduction treatment temperature of less than 200° C., the degree of reduction is not sufficient. At a reduction treatment temperature in excess of 500° C., the material particles are fused while the reduction reaction is saturated so that reduction does not progress any more.

With a reduction treatment time of less than 1 hour, the degree of reduction is not sufficient. With a reduction treatment time in excess of 50 hours, the material particles are fused while the reduction reaction is saturated so that reduction does not progress any more.

The method of the nitridation treatment is the same as the above-described nitridation treatment method and therefore, a detailed explanation thereof will not be made. The nitridation treatment time is also the same as that in the above-described nitridation treatment method. However, the nitridation treatment time can be shortened from that for the above-described magnetic particle producing method using merely the nitridation treatment. The nitridation treatment time is preferably 3 to 50 hours and more preferably 3 to 20 hours.

With a nitridation treatment time of less than 3 hours, the degree of nitridation is not sufficient. With a nitridation treatment time in excess of 50 hours, nitridation is saturated while the material particles are fused.

While the material particles 20 as shown in FIG. 1B are used as the material as described above, the invention is not limited thereto. The material may be a mixture of the material particles 20 and another type of particles. Another type of particles have a size substantially the same as that of the material particles 20 and each have a core-shell structure in which an iron oxide layer is formed on the surface of an iron (Fe) fine particle. The iron oxide is not particularly limited and examples thereof include $Fe_2O_3$ and $Fe_3O_4$.

It was confirmed that when a series of the above-described steps including the oxidation treatment step, the reduction treatment step and the nitridation treatment step are performed with the use of the mixture of the material particles 20 and another type of particles as the material, and even when the content of the other type of particles is about a half in terms of percent by volume, the magnetic particles 10 as shown in FIG. 1A are of course produced and in addition, magnetic particles each having a core-shell structure in which an iron oxide layer (shell) is formed on the surface of an iron nitride fine particle (core) are produced. It was also confirmed that the foregoing magnetic particles having the iron oxide layers have a size substantially the same as that of the magnetic particles 10 as shown in FIG. 1A. Furthermore, the magnetic particles 10 and the foregoing magnetic particles having the iron oxide layers do not adhere to each other but disperse.

It was confirmed that when the mixture of the material particles 20 and the other type of particles described above is used as the material and subjected to merely the nitridation treatment, and even when the content of the other type of particles is about a half in terms of percent by volume, the magnetic particles 10 and the foregoing magnetic particles having the iron oxide layers can be produced with substantially the same particle sizes and in addition, do not adhere to each other but disperse. Thus, even when the mixture of the material particles 20 and the other type of particles is used as the material, the magnetic particles 10 can be obtained and in addition, the magnetic particles having the iron oxide layers described above can be obtained.

In the present invention, none of the oxidation treatment, reduction treatment and nitridation treatment methods is limited to the foregoing methods as long as each iron fine particle 22 that is a core can be oxidized, reduced and nitrided to be changed into the iron nitride fine particle 12 with the core-shell structure of the material particle 20 as the material being maintained.

In addition to the method shown in FIG. 10A, there is another method for producing the magnetic particles of the invention as shown in FIG. 10B. In this method, the material particles 20 are subjected to drying and reduction treatment (Step S20) to dry and reduce the material particles 20 before nitridation treatment. In Step S20, the drying and reduction treatment is performed, for instance, at a temperature of 300° C. with a retention time of 1 hour. Thereafter, the material particles 20 are subjected to nitridation treatment to nitride the iron (Fe) fine particles 22 (Step S22). The magnetic particles 10 having the iron nitride fine particles 12 can be thus produced.

In the case where water is adsorbed to the material particles 20, if heat is simply applied thereto to evaporate the water, iron may react with the water and be oxidized. However, owing to the drying and reduction treatment, heat is applied in a reducing atmosphere using hydrogen and therefore, water can be removed without an oxidation reaction.

As described above, the material particles 20 are dried up in the drying and reduction treatment step (Step S20). Thereafter, the iron fine particles 22 are nitrided in the nitridation treatment step (Step S22) to obtain fine particles composed of iron nitride and most preferably of $Fe_{16}N_2$. At this time, the aluminum oxide layer 24 is stable and does not change into another substance through the drying and reduction treatment and the nitridation treatment. Thus, each iron fine particle 22 that is a core is dried and reduced and then nitrided to be changed into the iron nitride fine particle 12 with the core-shell structure being maintained, thereby obtaining the magnetic particle 10 shown in FIG. 1A.

When the material particles 20 are left to stand in the air or adsorbed with water, an oxide film may be formed on the surface of each iron fine particle 22 and interfere a smooth progress of nitridation. However, the drying and reduction treatment performed before the nitridation treatment serves to prevent surface oxidation from occurring at the surface of each iron fine particle 22 and to remove a surface oxide film, thereby achieving smooth nitridation.

Methods of the drying and reduction treatment include a method in which: the material particles 20 are put into, for example, a glass container; hydrogen gas ($H_2$ gas) or hydrogen gas-containing inert gas is supplied into this container; the material particles 20 are heated to a temperature of, for example, 200° C. to 500° C. in a hydrogen gas atmosphere or a hydrogen gas-containing inert gas atmosphere; and this temperature is retained for 1 to 20 hours. In this method, the drying and reduction treatment is performed more preferably at a temperature of 200° C. to 400° C. with a retention time of 3 hours.

At a drying and reduction treatment temperature of less than 200° C., the degree of reduction is not sufficient. At a drying and reduction treatment temperature in excess of 500° C., the material particles are fused while drying and reduction are saturated so that they do not progress any more.

With a drying and reduction treatment time of less than 1 hour, the degrees of drying and reduction are not sufficient. With a drying and reduction treatment time in excess of 20 hours, the material particles are fused while drying and reduction are saturated so that the drying does not progress any more.

Also in this case, a method of the nitridation treatment in the nitridation treatment step (Step S22) is the same as the above-described nitridation treatment method and therefore, a detailed explanation thereof will not be made. The nitridation treatment time is also the same as that in the above-described nitridation treatment method. However, the nitridation treatment time can be shortened from that for the above-described magnetic particle producing method using merely the nitridation treatment. The nitridation treatment time is preferably 3 to 50 hours. With a nitridation treatment time of less than 3 hours, the degree of nitridation is not sufficient. With a nitridation treatment time in excess of 50 hours, nitridation is saturated while the material particles are fused.

The magnetic particle producing method shown in FIG. 10A may be combined with the drying and reduction treatment shown in FIG. 10B. In this case, as shown in FIG. 10C, the material particles 20 are subjected to the drying and reduction treatment (Step S30), subsequently the oxidation treatment (Step S32) and then the reduction treatment (Step S34) before the nitridation treatment. Thereafter, the material particles 20 are subjected to the nitridation treatment (Step S36) whereby the magnetic particles 10 having the iron nitride fine particles 12 can be produced. In this case, the drying and reduction treatment performed before the nitridation treatment as described above serves to prevent surface oxidation from occurring at the surface of each iron fine particle 22 and to remove a surface oxide film, thereby achieving smooth nitridation in the nitridation treatment later performed. Furthermore, owing to the oxidation treatment and the reduction treatment, by oxidation, each iron fine particle 22 that is a core is expanded during oxidation so that a crack or the like occurs at the aluminum oxide layer 24 that is a shell and by succeeding reduction, oxygen present in the iron fine particle 22 (core part) comes out and this allows iron of the iron fine particle 22 (core part) to have reduced density compared to that before the oxidation and reduction treatments, thereby achieving smooth nitridation in the nitridation treatment later performed.

The drying and reduction treatment step (Step S30) above is the same as the drying and reduction treatment step (Step S20) shown in FIG. 10B and therefore, a detailed explanation thereof will not be made. The oxidation treatment step (Step S32) above is the same as the oxidation treatment step (Step S10) shown in FIG. 10A and therefore, a detailed explanation thereof will not be made. Likewise, the reduction treatment step (Step S34) above is the same as the reduction treatment step (Step S12) shown in FIG. 10A and therefore, a detailed explanation thereof will not be made.

The present applicants used material particles ($Fe/Al_2O_3$ particles) with an average particle size of 62 nm as the material and subjected the material particles ($Fe/Al_2O_3$ particles) to the oxidation treatment, the reduction treatment and the nitridation treatment in this order, thereby producing magnetic particles. The material particles in the production process and the produced magnetic particles were analyzed for their crystal structures by X-ray diffractometry and the results were obtained as shown in FIGS. 11A to 11C and FIGS. 12A and 12B.

FIG. 11A is a graph showing the crystal structure analysis result as obtained before the oxidation treatment by X-ray diffractometry and FIGS. 11B and 11C are graphs showing the crystal structure analysis results as obtained after the oxidation treatment by X-ray diffractometry. FIGS. 12A and 12B are graphs showing the crystal structure analysis results as obtained after the nitridation treatment by X-ray diffractometry. FIGS. 12A and 12B show the analysis results on magnetic particles obtained by subjecting the material particles having the crystal structure shown in FIG. 11C to the nitridation treatment.

In the oxidation treatment step, the oxidation treatment was performed in the air at a temperature of 300° C. for 2 or 4 hours.

In the reduction treatment step, the reduction treatment was performed in the presence of hydrogen at a temperature of 300° C. for 15 hours. For this treatment in the presence of hydrogen, use was made of mixed gas of $H_2$ gas (hydrogen gas) and $N_2$ gas (nitrogen gas) with an $H_2$ gas concentration of 4 vol %.

In the nitridation treatment step, the nitridation treatment was performed in an ammonia gas atmosphere at a temperature of 145° C. for 10 or 15 hours.

Comparing diffraction peaks of the material particles shown in FIG. 11A and diffraction peaks shown in FIG. 11B associated with the case with an oxidation time of 2 hours, diffraction peaks of iron oxides are exhibited in FIG. 11B and this means that the iron (Fe) fine particles 22 were oxidized. Likewise, comparing diffraction peaks of the material particles shown in FIG. 11A and diffraction peaks shown in FIG. 11C associated with the case with an oxidation time of 4 hours, diffraction peaks of iron oxides are exhibited in FIG. 11C and this means that the iron (Fe) fine particles 22 were oxidized.

Through the nitridation treatment following the reduction treatment, the diffraction peaks of the iron oxides disappeared and diffraction peaks of $Fe_{16}N_2$ appeared as shown in FIGS. 12A and 12B, so that it is clear that the iron oxides were changed to iron nitride ($Fe_{16}N_2$) by the nitridation treatment.

The applicants produced magnetic particles by two of the above-described magnetic particle producing methods with different nitridation treatment times and measured the respective yields of obtained iron nitride. The results are shown in FIG. 13.

FIG. 13 is a graph showing the relation between the nitridation treatment time and the iron nitride yield as to magnetic particles produced by a method in which the nitridation treatment is preceded by the oxidation treatment and the reduction treatment and the relation therebetween as to magnetic particles produced only by the nitridation treatment. The iron nitride yield was determined by analyzing the crystal structure by X-ray diffractometry and calculating by a known method the proportion of iron nitride based on the obtained diffraction peaks.

In FIG. 13, the letter D denotes magnetic particles obtained only by the nitridation treatment without the oxidation treatment and the reduction treatment. In the case of D, use was made of material particles ($Fe/Al_2O_3$ particles) with an average particle size of 33 nm and the nitridation treatment temperature was 145° C. The letter E denotes magnetic particles obtained by the oxidation treatment, the reduction treatment and the nitridation treatment. The case of E corresponds to the cases shown in FIGS. 12A and 12B and use was made of material particles ($Fe/Al_2O_3$ particles) with an average particle size of 62 nm as described above.

As shown in FIG. 13, in the case of performing only the nitridation treatment, as the nitridation treatment time, it takes 40 hours to closely approach the convergence of nitridation. On the other hand, in the case of performing the oxidation treatment and the reduction treatment prior to the nitridation treatment, it takes 15 hours to closely approach the convergence of nitridation. Thus, by performing the oxidation treatment and the reduction treatment as previous steps of the nitridation treatment step, the nitridation treatment time can be shortened while the iron nitride yield can be increased.

The present invention is basically configured as above. While the method for producing magnetic particles, the magnetic particles and the magnetic body according to the invention have been described above in detail, the invention is by no means limited to the foregoing embodiments and it should be understood that various improvements and modifications are possible without departing from the scope and spirit of the invention.

REFERENCE SIGNS LIST

10 magnetic particle
12, 22 fine particle
14, 24 aluminum oxide layer
20 material particle

The invention claimed is:

1. A magnetic particle producing method, comprising:

a nitridation treatment step of subjecting material particles each having a core-shell structure in which an aluminum oxide layer is formed on a surface of an iron fine particle to nitridation treatment to nitride iron fine particles with the core-shell structure being maintained, wherein the method further includes, before the nitridation treatment step, an oxidation treatment step of subjecting the material particles to oxidation treatment and a reduction treatment step of subjecting the material particles having undergone the oxidation treatment to reduction treatment, and wherein in the nitridation treatment step, the nitridation treatment is performed on the material particles having undergone the reduction treatment.

2. The magnetic particle producing method according to claim 1, including a drying and reduction treatment step of subjecting the material particles to drying and reduction treatment before the nitridation treatment step, wherein in the nitridation treatment step, the nitridation treatment is performed on the material particles having undergone the drying and reduction treatment.

3. The magnetic particle producing method according to claim 2, wherein the drying and reduction treatment is performed by, as supplying hydrogen gas or hydrogen gas-containing inert gas, heating the material particles to a temperature of 200° C. to 500° C. in a hydrogen gas atmosphere or a hydrogen gas-containing inert gas atmosphere and retaining the temperature for 1 to 20 hours.

4. The magnetic particle producing method according to claim 1, wherein the oxidation treatment is performed by heating the material particles to a temperature of 100° C. to 500° C. in air and retaining the temperature for 1 to 20 hours.

5. The magnetic particle producing method according to claim 1, wherein the reduction treatment is performed by, as supplying mixed gas of hydrogen gas and nitrogen gas to the material particles, heating the material particles to a temperature of 200° C. to 500° C. and retaining the temperature for 1 to 20 hours.

6. The magnetic particle producing method according to claim 1, wherein the nitridation treatment is performed by, as supplying nitrogen element-containing gas to the material particles, heating the material particles to a temperature of 140° C. to 200° C. and retaining the temperature for 3 to 50 hours.

7. The magnetic particle producing method according to claim 2, wherein the drying and reduction treatment step comes before the nitridation treatment step, and the oxidation treatment step and the reduction treatment step come in this order after the drying and reduction treatment step.

8. The magnetic particle producing method according to claim 1, wherein the material particles take on a spherical shape and have a particle size of less than 200 nm.

9. The magnetic particle producing method according to claim 2, wherein the nitridation treatment is performed by, as supplying nitrogen element-containing gas to the material particles, heating the material particles to a temperature of 140° C. to 200° C. and retaining the temperature for 3 to 50 hours.

10. The magnetic particle producing method according to claim 3, wherein the nitridation treatment is performed by, as supplying nitrogen element-containing gas to the material particles, heating the material particles to a temperature of 140° C. to 200° C. and retaining the temperature for 3 to 50 hours.

* * * * *